US011596992B2

(12) United States Patent
Bruhnke

(10) Patent No.: US 11,596,992 B2
(45) Date of Patent: Mar. 7, 2023

(54) DEVICE FOR PRODUCING METAL SHEETS OR HOLLOW CHAMBER PLATES FROM EXTRUDED PROFILES

(71) Applicant: Ulrich Bruhnke, Ehningen (DE)

(72) Inventor: Ulrich Bruhnke, Ehningen (DE)

( * ) Notice: Subject to any disclaimer, the term of this patent is extended or adjusted under 35 U.S.C. 154(b) by 27 days.

(21) Appl. No.: 17/250,111

(22) PCT Filed: May 24, 2019

(86) PCT No.: PCT/DE2019/000150

§ 371 (c)(1),
(2) Date: Nov. 30, 2020

(87) PCT Pub. No.: WO2019/228579

PCT Pub. Date: Dec. 5, 2019

(65) Prior Publication Data

US 2021/0291246 A1 Sep. 23, 2021

(30) Foreign Application Priority Data

Jun. 1, 2018 (DE) ..... 10 2018 004 387.9

(51) Int. Cl.
*B21C 35/03* (2006.01)
*B21C 23/00* (2006.01)
(Continued)

(52) U.S. Cl.
CPC ..... *B21C 35/03* (2013.01); *B21C 23/002* (2013.01); *B21C 23/211* (2013.01); *B21C 23/22* (2013.01);
(Continued)

(58) Field of Classification Search
CPC ..... B21C 23/002; B21C 23/06; B21C 23/211; B21C 23/22; B21C 29/04; B21C 35/03;
(Continued)

(56) References Cited

U.S. PATENT DOCUMENTS 1,133,903 A 3/1915 Wright
2,681,764 A 6/1954 Gale
(Continued)

FOREIGN PATENT DOCUMENTS

DE 1804666 A1 6/1971
DE 4333500 A1 4/1995
(Continued)

*Primary Examiner* — Kristina N Junge
*Assistant Examiner* — Jared O Brown
(74) *Attorney, Agent, or Firm* — Smartpat PLC

(57) ABSTRACT

An apparatus for producing metal sheets from extruded profiles of small thickness or of hollow chamber plates of light metal, preferably of magnesium or magnesium alloys, comprises an extruder for producing an extruded profile which is open along a surface line. A separating device is provided for cutting the extruded profile to length corresponding to the length of the metal sheet to be produced, or the hollow chamber plate to be produced. A bending unit is used for deforming the extruded profile into a U-shaped profile. An expansion unit is provided for expanding the U-shaped profile into a flat metal sheet or a hollow chamber plate. A stacking unit is also provided. At least one expansion unit is arranged parallel to the extrusion line and thus the extrusion and expanding processes are decoupled from one another.

12 Claims, 8 Drawing Sheets

(51) Int. Cl.

| | |
|---|---|
| ***B21C 37/02*** | (2006.01) |
| ***B21D 3/02*** | (2006.01) |
| ***B21D 25/04*** | (2006.01) |
| ***B21D 37/16*** | (2006.01) |
| ***B21C 23/21*** | (2006.01) |
| ***B21C 23/22*** | (2006.01) |
| ***B21C 29/04*** | (2006.01) |
| ***B21C 35/04*** | (2006.01) |

(52) U.S. Cl.
CPC ..... *B21C 29/04* (2013.01); *B21C 35/04* (2013.01); *B21C 37/02* (2013.01); *B21D 3/02* (2013.01); *B21D 25/04* (2013.01); *B21D 37/16* (2013.01)

(58) Field of Classification Search
CPC ..... B21C 35/04; B21C 37/02; B21C 35/00; B21C 35/02; B21C 35/023; B21C 35/026; B21C 35/06; B21D 1/02; B21D 3/02
See application file for complete search history.

(56) References Cited

U.S. PATENT DOCUMENTS

| | | | | |
|---|---|---|---|---|
| 3,002,255 | A | 10/1961 | Grossu | |
| 4,648,786 | A * | 3/1987 | Sakurai | B21D 43/105 72/405.1 |
| 5,829,298 | A | 11/1998 | Linsenbardt et al. | |
| 6,070,448 | A | 6/2000 | Eipper et al. | |
| 2002/0162373 | A1* | 11/2002 | Schramm | B21D 3/05 72/162 |
| 2004/0045335 | A1* | 3/2004 | Lindner | B21C 35/02 72/254 |
| 2012/0198904 | A1* | 8/2012 | Li | B21D 11/02 72/311 |
| 2013/0205863 | A1* | 8/2013 | Loesch | B21D 22/022 72/352 |
| 2015/0343508 | A1* | 12/2015 | Del Fabro | B21D 3/02 72/162 |
| 2016/0030995 | A1* | 2/2016 | Jin | B21D 28/02 72/39 |
| 2016/0096221 | A1* | 4/2016 | Anderseck | B21C 35/03 164/460 |
| 2016/0101475 | A1 | 4/2016 | Anderseck | |
| 2017/0128994 | A1 | 5/2017 | Lindner et al. | |
| 2017/0209909 | A1 | 7/2017 | Kavik et al. | |
| 2018/0304341 | A1 | 10/2018 | Frost et al. | |

FOREIGN PATENT DOCUMENTS

| | | | |
|---|---|---|---|
| DE | 10317080 | A1 | 11/2004 |
| DE | 102007002322 | A1 | 7/2008 |
| DE | 102008048496 | A1 | 4/2010 |
| DE | 102013008632 | A1 | 11/2014 |
| DE | 102014008646 | | 9/2015 |
| DE | 102015118099 | A1 | 4/2017 |
| EP | 1063443 | A1 | 12/2000 |
| EP | 2996825 | B1 | 12/2016 |
| GB | 556061 | A | 9/1943 |
| GB | 2469549 | A | 10/2010 |
| WO | 2014187442 | A1 | 11/2014 |
| WO | 2016012009 | A1 | 1/2016 |

* cited by examiner

DEVICE FOR PRODUCING METAL SHEETS OR HOLLOW CHAMBER PLATES FROM EXTRUDED PROFILES

TECHNICAL FIELD

The disclosure relates to an apparatus for producing metal sheets from round or approximately round thin-walled extruded profiles or hollow chamber plates, which are in particular made of magnesium or magnesium alloys, by an extruder. Plate-shaped extruded profiles with inner webs connected to opposite profile walls and at least two mutually adjacent hollow chambers featuring a common inner web, which are also known as web plates or double-web plates, are referred to as hollow chamber plates.

BACKGROUND

The production of sheet metal by casting a liquid alloy between two rollers and then numerous rolling and heat treatment processes is generally known. Due to the large number of rolling passes from coarse to thin sheet, this process is highly cost-intensive. These steps are necessary to achieve a deformable wrought structure from a cast structure. The high number of rolling passes is cost-intensive.

DE 43 33 500 C2 discloses a method for producing a sheet with a stepped cross-section and a solid profile with different wall thicknesses, with which a semi-finished product is initially produced, whose cross-section is similar to the cross-section of the sheet in the thickness direction, and with which a sheet is rolled from the semi-finished product, wherein, for the production of the semi-finished product, a hollow profile with a wall thickness profile distributed around the circumference and corresponding to the desired wall thickness profile of the semi-finished product is extruded, and in so doing the hollow profile is cut along a surface line and deformed into the semi-finished product. In addition, two complementary profiles are placed one on top of the other, wherein at least one of the profiled contact sides of the complementary profiles is provided with a release agent, and the two complementary profiles are rolled out simultaneously with cylindrical, that is, non-stepped rollers. Prior to rolling, the two complementary profiles are separated on two opposite surface lines.

This method is used to produce two parts at a time. The production process is discontinuous, and only relatively narrow parts can be produced. A further disadvantage is that the production process is relatively costly due to the manufacture of the semi-finished product with two different wall thicknesses and a stepped roller arrangement.

DE 10 2008 048 496 A1 describes a method for producing sheet metal parts and a device for carrying out the method. The method comprises the steps of—extruding or continuous casting of a tubular body,—cutting of the tubular body open in its longitudinal direction,—expanding of the tubular body to form a flat body,—producing of the flat body to form the component according to drawing by means of known production technologies. The device essentially consists of a chain of a melting unit, a continuous casting or extrusion unit, a longitudinal cutting device, a roll stand, one or more deforming units.

From DE 10 2007 002 322 A1, a method for the production of sheet metal or sheet metal parts made of light metal, preferably magnesium, is known, wherein, in one or more preceding method steps, an extruded profile is produced in an open structure or a closed structure with subsequent slitting to form an open structure, and this is then subjected in one or more steps to straightening rolling and straightening bending over several rolling and bending stages.

GB 2469 549 A describes a method for producing a support structure, preferably a support structure for a vehicle seat with at least one seat shell for the seat part and/or the backrest of the vehicle seat, with the method steps of producing a metallic semi-finished product and deforming it into an essentially flat sheet metal, separating a sheet metal part from the sheet metal and deforming the sheet metal part, wherein the production of the metallic semi-finished product is effected by means of extrusion.

U.S. Pat. No. 2,681,764 A describes a device for extruding wide sheet metal comprising a die element with a base section in the form of an elongated U-shaped slit for producing a U-shaped profile, which is subsequently flattened.

U.S. Pat. No. 1,133,903 A describes the transformation of metal tubes into flat strips by cutting the tubes lengthwise and expanding them by means of a double flying blade and subsequent rolling.

U.S. Pat. No. 3,002,255 A describes a method for producing continuous metal strips and the like. Production takes place by extruding a plurality of blocks successively in a form other than flat, flattening them step-by-step after extrusion and keeping the form under tension during the flattening step, and winding up the previously flattened strips during each extrusion step.

GB 556 061 describes an improvement in the production of iron and steel sheet metal from tubes that are continuously produced by casting. After leaving the die of the extruder, they are cut open lengthwise and expanded and smoothed by means of forming rollers.

U.S. Pat. No. 5,829,298 A describes a method and a device for the continuous production of metal strips, wherein a workpiece is fed to a punch to form a tube with a circular cross-section and a slit formed therein, and the tube is opened and flattened by outward bending in opposite directions in the slit area.

EP 2996825 B1 describes a method and apparatus for producing metal sheets from extruded profiles of small thickness, in particular of magnesium or magnesium alloys, wherein the extruded profile exiting the extrusion die is formed into a metal sheet. The facility consists of an extruder with a die producing the extruded profile and a deformation unit following the die, wherein the deformation unit consists of a cutting unit for cutting the extruded profile according to the length of the metal sheet to be produced, a bending unit for bending the profile into a U-shape and a coiling unit for coiling the U-shaped profile into a metal sheet.

SUMMARY

An apparatus for the production of metal sheets from round or approximately round thin-walled extruded profiles or hollow chamber plates, in particular made of magnesium or magnesium alloys is disclosed. The preferably open extruded profile exiting an extrusion die is expanded to form a metal sheet or a hollow chamber plate, and the expansion process is decoupled from the extrusion process.

The open extruded profile emerging from the extrusion die of an extruder is cut off according to the length of the metal sheet or hollow chamber plate to be produced. The longitudinal gap of the open extruded profile is widened, preferably to an approximately U-shaped profile, and then transferred to an expansion unit, in which it is expanded to form a flat sheet or plate and then placed in a stacking unit.

The apparatus has at least one, preferably two, expansion units arranged parallel to the direction of extrusion. Metal sheets with a thickness <5.0 mm, preferably with a thickness in the range <2.5 mm, in particular from 1.0 to 1.5 mm, or hollow chamber plates are produced.

In a first step, the extruded profile emerging from the die is cut off according to the length of the metal sheet to be produced and, in a second step, the longitudinal gap of the open extruded profile is widened, preferably to an approximately U-shaped profile. In the subsequent third step, the U-shaped profile is brought into an expansion unit and gripped by clamping devices on the longitudinal sides of the U-shaped profile and deformed into a metal sheet or hollow chamber plate by means of the clamping devices moving outwards.

The open extrusion profile can also be deformed to form a metal sheet or a hollow chamber plate alternatively by at least one pair of rollers, which are inserted into the open extrusion profile and by moving the individual rollers in the direction of the longitudinal edge areas.

Another possibility for the design of the expansion unit is that it consists of a combination of gripping elements and two movable rollers that can be inserted into the U-shaped profile. In order to protect the surface of the metal sheet to be produced, the rolls can be provided with a heat-resistant elastic surface coating. The rollers used for this are designed in such a manner that they do not cause any surface damage.

One possibility for expanding an open extrusion profile into a metal sheet or a flat hollow chamber plate includes forming the open extrusion profile into a metal sheet or a hollow chamber plate by means of a 3-roller unit.

The 3-roller unit of the expansion unit includes two upper rollers arranged parallel to each other and a lower roller adjustable in the longitudinal direction of the upper rollers. A feed unit, preferably consisting of a pair of rollers, is provided to transport the profile through the 3-roller unit.

Another possibility for expanding the open extruded profile is to insert the profile with its opening facing upwards into the expansion unit and then retract the 3-roller unit, wherein the upper rollers are provided inside the profile and the lower roller is provided outside the profile. By moving the 3-roller unit to the left and right, the profile is expanded to form a metal sheet or a hollow chamber plate.

The deforming into sheet metal or hollow chamber plate is preferably carried out in a temperature range above 200° C. and in a dry, preferably inert, atmosphere.

The apparatus for producing a metal sheet from an extruded profile consists essentially of a furnace for heating the extrusion billets to extrusion temperature, an extruder with a die for extruding a hollow profile open in the longitudinal direction, a separating device for cutting the extruded profile to length and a bending unit. At least one expansion unit and a subsequent stacking unit are provided parallel to such bending unit.

To precisely size the expanded metal sheets or hollow chamber plates, a sizing and squeezing unit can be provided between the expansion unit and the stacking unit, in which the metal sheet is hot squeezed, that is, smoothed, between two heated embossing plates. The sizing and squeezing unit can be designed in the form of a simple hydraulic press.

The metal sheets are preferably placed in the stacking unit by a robot, which uses suction cups to pick up the metal sheet or hollow chamber plates from either the expanding or the sizing and squeezing unit and places them in the stacking unit.

Machining or non-machining devices can be used as separating devices to cut the extruded profile to length in accordance with the length of the metal sheet. Saws, for example, can be used as machining separating devices, while circulating jet nozzles, laser separating devices or wedge or pinch cutting are used as non-machining separating devices.

BRIEF DESCRIPTION OF THE DRAWINGS

The invention shall be described in more detail by reference to an exemplary embodiment and the drawings.

DETAILED DESCRIPTION

Figure 1:
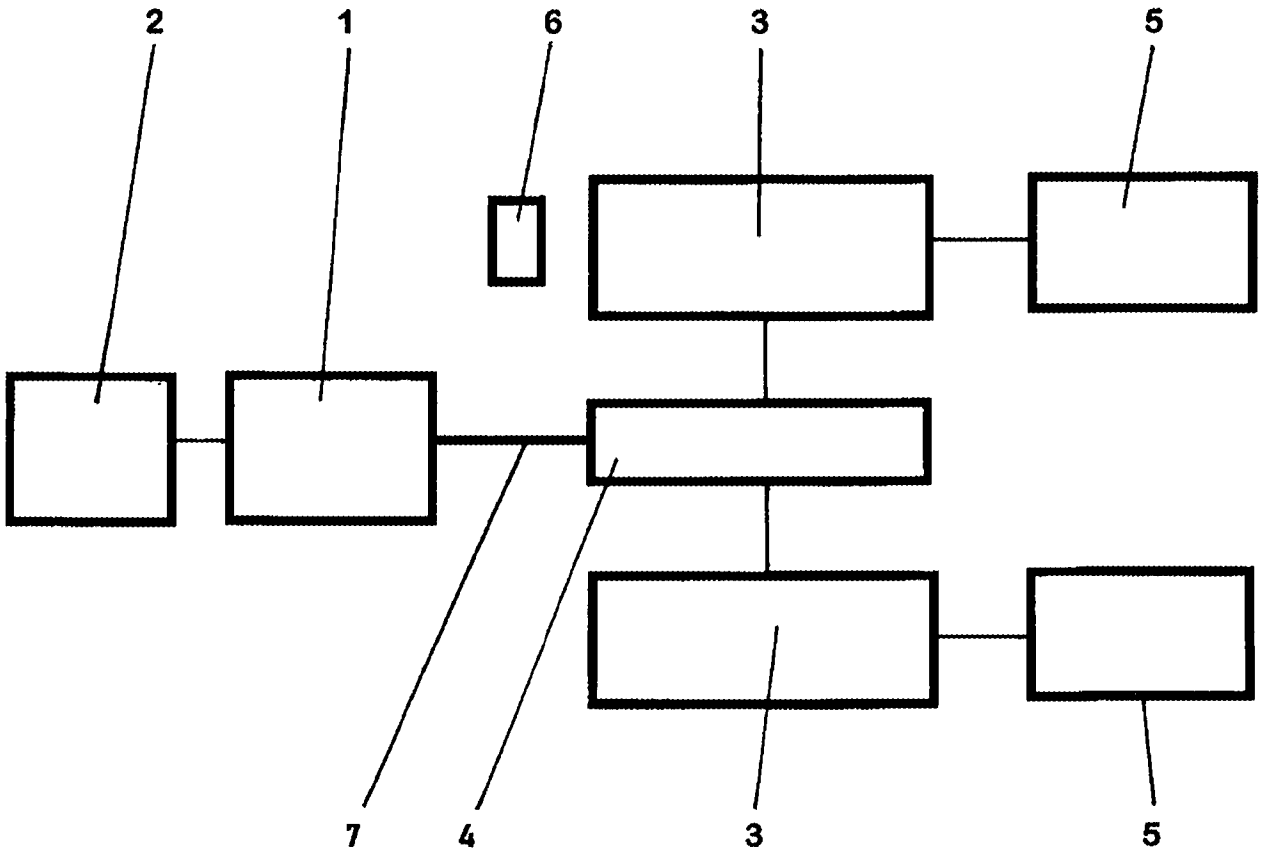
FIG. 1 is a block diagram illustrating the principle structure of the apparatus.

FIG. 1 shows the principal structure of the apparatus for producing metal sheets from extruded profiles. The apparatus essentially consists of an extruder 1 for producing an extruded profile 7 with an upstream furnace 2 for heating the extrusion billet 8 to extrusion temperature. A bending unit 4 is arranged downstream of the extruder 1 in the extrusion direction. A separating device 6 is used for cutting to length the extruded profile 7—hereinafter referred to as hollow profile 7. Two expansion units 3 are arranged parallel to the extrusion direction with a subsequent stacking unit 5.

All devices of the apparatus are interlinked. The transfer of the U-shaped profile 7 to the expansion unit 3 and of the expanded profile 7 to the stacking unit 5 and, if necessary, to the interposed sizing and squeezing unit is carried out by handling devices, preferably by industrial robots. For this purpose, the handling devices are equipped with mechanical or pneumatic gripping systems.

Figure 2:
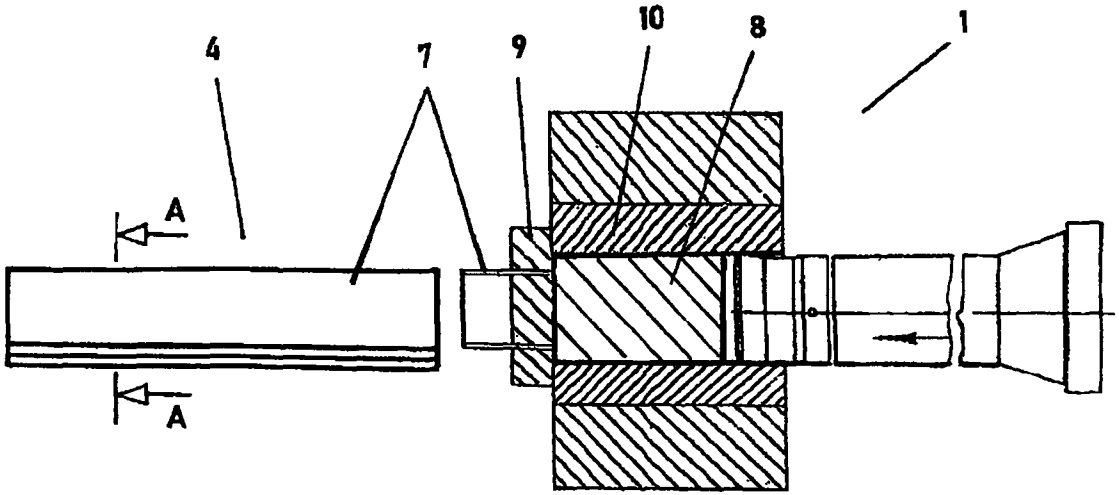
FIG. 2 shows a cutout of the apparatus.
Figure 4:
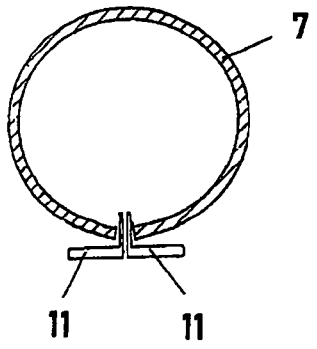
FIG. 4 shows a cross-section A-A of FIG. 2.

FIG. 2 shows a cutout of the apparatus for producing metal sheets from extruded profiles 7. The extrusion billet 8 heated in the furnace 2 to extrusion temperature between 200 and 520° C., preferably to 470° C., is inserted into the recipient 10 of the extruder 1 and pressed out to an open profile 7. That is, the profile 7 is slit in the longitudinal direction, by applying pressure through the die 9. FIG. 4 shows a section A-A through the pressed out profile 7.

Figure 3A:
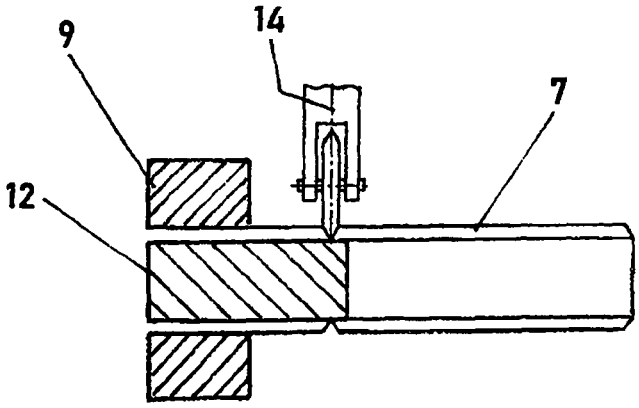
FIG. 3*a* and FIG. 3*b* illustrate cutting of the hollow profile to length.

After a predetermined length of the profile 7 has been pressed out, the extruder is stopped and the profile 7 is cut to length by the separating device 6 according to the length of the metal sheet to be produced. FIG. 3*a* shows a variant of the separating device 6 for cutting the open profile 7 to length. The hollow profile 7 is cut to length from the extruded strand by a wedge cutting device 14, with which one or more wedge cutting wheels 14 cut the profile 7 from the extrusion around the circumference. The wedge cutting wheels(s) separate the material lying on a base and is pressed apart by moving the wedge-shaped cutting edges towards each other. The base is formed by extending the piercing plug 12.

Figure 3B:
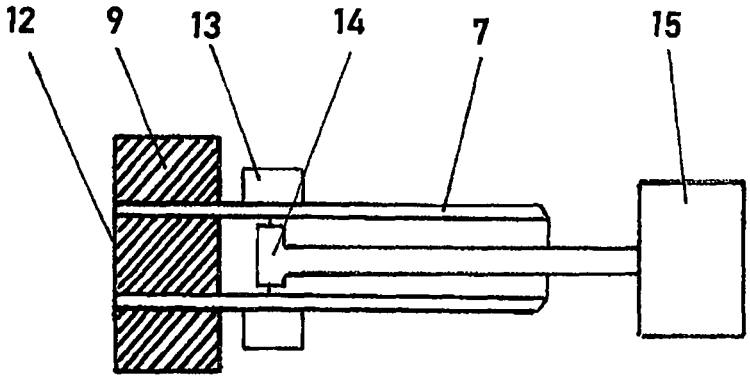

An additional variant of cutting to length the hollow profile 7 from the extrusion is shown in FIG. 3*b*. A ring-shaped counter bearing 13 is located on the outer side of the profile 7. The wedge cutting device 14 is driven into the interior. Two opposite, hydraulically movable wedge cutting wheels are arranged at the end and separate the material with simultaneous rotary movement. The application of pressure to and rotation of the wedge cutting device 14 is effected by the drive and hydraulic device 15.

Wedge or pinch cutting has the advantage that, being a chipless cutting process, it does not produce any chips or splinters that would otherwise have to be removed from the surface in the cutting area.

After the profile 7 has been cut to length, it is released from the extrusion unit. The profile 7, which is slotted in the longitudinal direction and placed on the angle rails 11 of the bending unit 4, is moved out of the area of the separating device 6. Subsequently, the profile 7 is bent open into a U-shape (FIG. 5) by moving the angle rails 11 apart.

Figure 5:
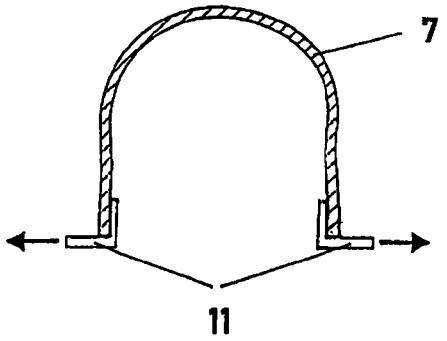
FIG. 5, FIG. 5*a*, FIG. 5*b*, and FIG. 5*c* illustrate the expansion process of the U-shaped profile.
Figure 5A:
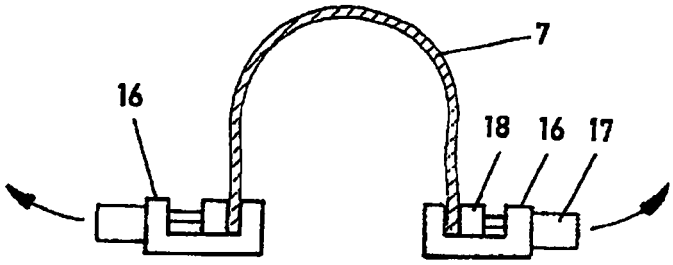
Figure 5B:
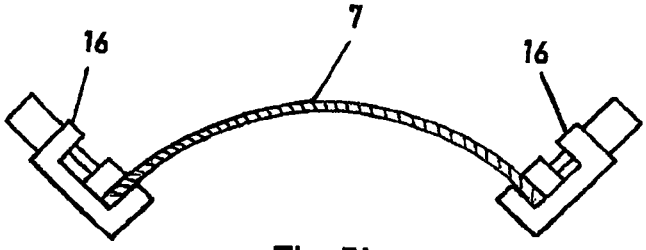
Figure 5C:
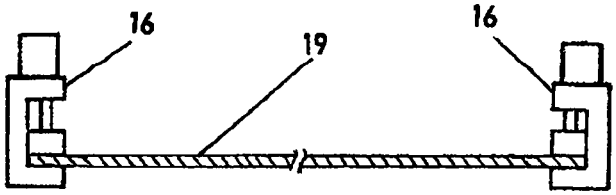

The U-shaped bent profile 7 is grasped by a handling device (not shown in detail) and transferred to the expansion unit 3. Here, the U-shaped profile 7 is fully expanded. For this purpose, the profile 7 is inserted with its longitudinal sides into the rotatably mounted clamping units 16, wherein the profile 7 is deformed into a flat sheet by moving the clamping units 16 apart. FIGS. 5 *a* to 5 *c* show the individual sections of the expanding of the profile 7 to form a flat metal sheet 19.

The U-shaped bent profile 7 inserted in the clamping units 14 of the expansion unit 3 is clamped by the clamping rail 18 in the clamping unit 16. Clamping is achieved by applying pressure to the clamping rail 18. For this purpose, at least two hydraulic cylinders 17 are arranged along the outer side of the clamping rails over their length.

The U-shaped profile 7 is expanded to form a flat metal sheet 19 (FIG. 5 *c*) by driving apart the clamping units 16. Subsequently, the metal sheet 19 is gripped by a handling device, preferably by a suction pad, and placed in the stacking unit 5.

If the metal sheets 19 still show unevenness after the expanding process, they are transferred to a sizing and squeezing unit prior to being placed in the stacking unit 5. For this purpose, the metal sheet 19 is clamped on the transverse side and moved into the sizing and squeezing station by a linear drive. In the sizing and squeezing unit, the metal sheet 19 is hot squeezed, which removes any unevenness that may exist.

The sizing and squeezing unit is formed by two heated embossing plates 24 that can be moved towards each other. The embossing plates 24 can be opened and closed by a simple hydraulic press.

After the sizing and squeezing process, the metal sheet is picked up by a handling device with a suction pad and placed in the stacking unit 5.

Figure 6:
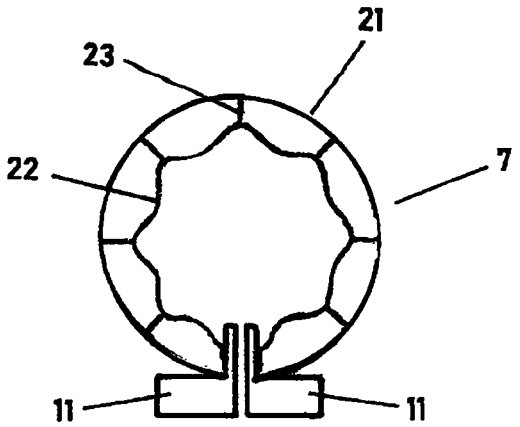
FIG. 6 shows a U-shaped multi-chamber profile.

In a further exemplary embodiment, the production of hollow chamber plates 20 is described. FIG. 6 shows the extruded profile 7 produced by means of the extruder 1, which forms the basis for a hollow chamber plate 20.

The extruded profile 7 is designed in such a manner that it assumes the shape of a flat hollow chamber plate 20 after expansion. The extruded profile 7 is designed in such a manner that the sections of the lower side 22 and the upper side 21 between the inner webs 23 have the same length. Consequently, the sections of the lower side 22 between the inner webs 23 are formed in an inwardly convex curved manner during extrusion. After the expansion process, the sections between the inner webs 23 on the lower side 22 and the upper side 21 have the same length.

The extruded profile 7 emerging from the die of the extruder 1 in a first step is cut off according to the hollow chamber plate 20 to be produced. As the separating device 6, a machining cutting device, for example a saw, is preferably used here. This is connected to an extraction system for the chips.

Subsequently, the extruded profile 7 is bent up into a U-shaped profile 7 by means of the bending unit 4 and is taken further into an expansion unit 3. The bending up to a U-shaped profile 7 takes place by moving the angle rails 11 of the bending unit 4 apart.

In the expansion unit 3, the U-shaped profile 7 is expanded to form a flat hollow chamber plate 20. After the expansion process, the hollow chamber plate 20 is placed in a sizing and squeezing unit.

Figure 7:
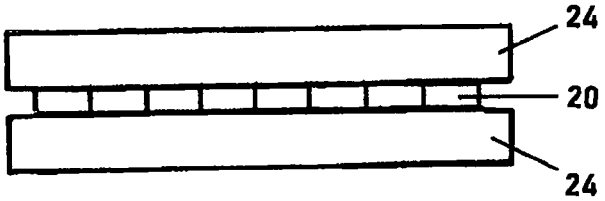
FIG. 7 shows the sizing and squeezing unit.

The sizing and squeezing unit is shown schematically in FIG. 7. It essentially consists of two heated embossing plates 24 that can be moved towards each other and between which the hollow chamber plate 20 is arranged during the sizing and squeezing process. In this manner, the hollow chamber plates 20 are brought to a uniform dimension with regard to the distance between the upper and lower sides 21, 22 and at the same time are also straightened.

Figure 8:
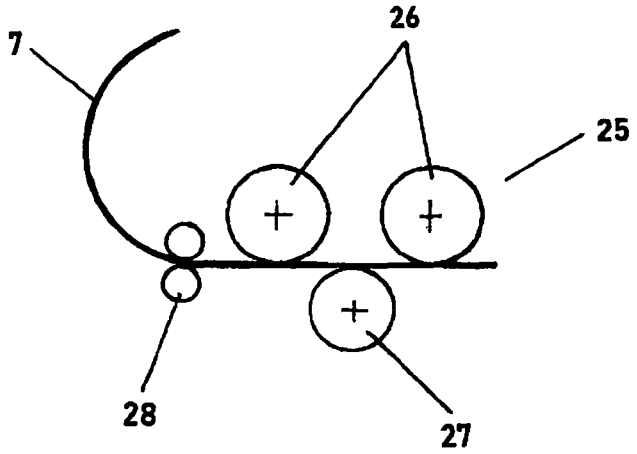
FIG. 8 shows an embodiment of an expansion unit.

FIG. 8 shows an additional embodiment of the expansion unit. This essentially consists of a 3-roller unit 25, the two upper rollers 26 and a lower roller 27 that can be moved in the direction of the upper rollers 26. A pair of rollers 28 is arranged in front of the 3-roller unit 25, with the assistance of which the profile 7 is transported into and through the 3-roller unit 25.

After the longitudinal side (front edge) of the profile 7 has been gripped by the pair of rollers 28, it is pushed in the direction of the 3-roller unit. If the front edge of the profile 7 reaches the second upper roller 26, the lower roller 27 is moved in the direction of the upper rollers 26. When the profile 7 is pushed further through the 3-roller unit 25, it is formed into a flat metal sheet 19, that is, it is expanded from the U-shaped profile 7 into the metal sheet 19. This can be followed by a sizing and squeezing step, or the metal sheet 19 can be placed directly in the stacking unit 5.

Figure 9:
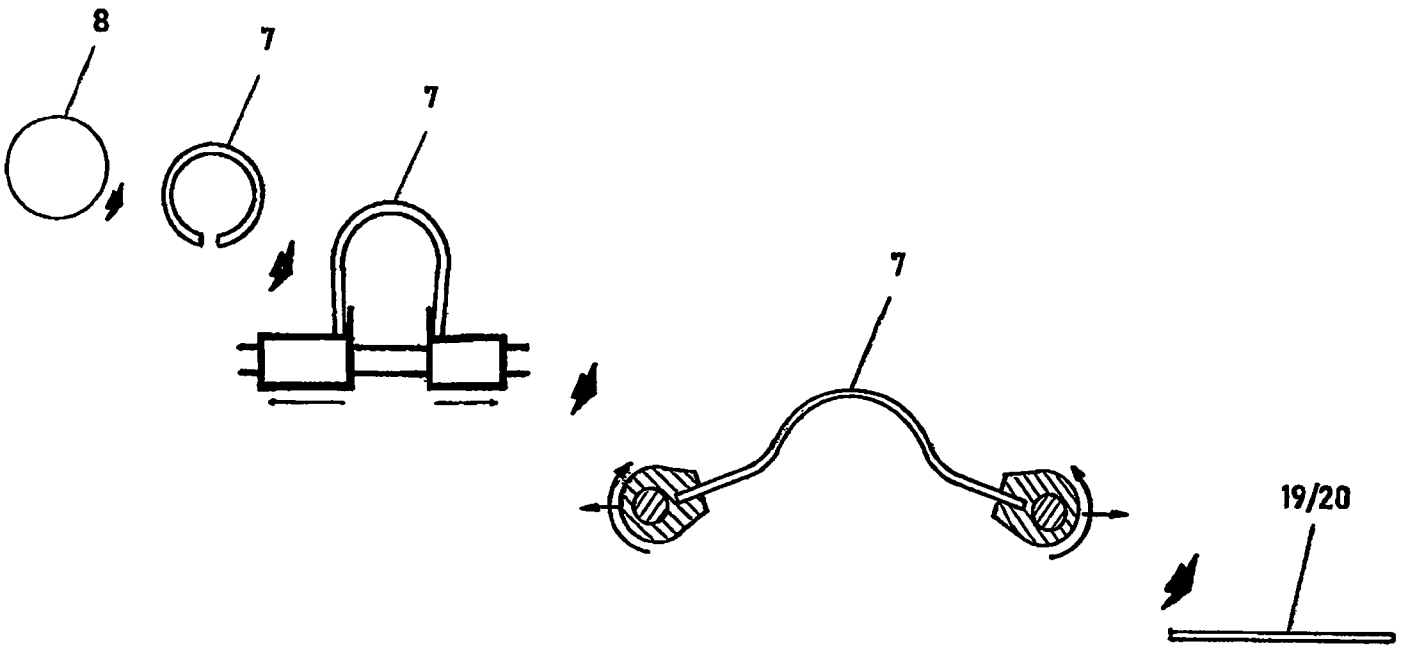
FIG. 9 illustrates a sequence of the production process.

FIG. 9 shows a simplified representation of the production process. Starting from the extrusion billet 8, a tubular open extrusion profile 7 is produced by means of an extruder 1 and is separated from the extrusion by a separating device 6 corresponding to the length of the plate 19 or the hollow chamber plate 20. The extruded profile 7 is subsequently bent into a U-shape. After the transfer to an expansion unit 3, the extruded profile 7 is expanded to form a metal plate 19 or a hollow chamber plate 20.

All parts of the apparatus that come into contact with the U-shaped profile 7 or the metal sheet 19 or the hollow chamber plate 20 are provided with a coating, preferably with a ceramic material, or are made of a magnesium-compatible material, in order to prevent direct contact with a ferrous material.

The apparatus for producing metal sheets or hollow chamber plates from extruded profiles has the advantage that the expansion process to form a flat sheet or hollow chamber plate is decoupled from the extrusion process, by which the number of cycles for the production can be substantially increased.

The extrusion of magnesium sheet also has the advantage of being able to produce very thin sheet thicknesses in a single process step and thus represents an alternative to rolling or casting-rolling.

Not only can very thin sheet thicknesses be realized here, but also very wide sheets can be produced by extruding hollow profiles, for example tubes. The extrusion process can also be used to produce very wide hollow chamber plates. The width results from the circumference of the extruded profiles in accordance with the formula u=d*n. For example, for a tube diameter of 300 mm, a sheet with a width of approximately 942 mm can be produced.

LIST OF REFERENCE SIGNS

1 Extruder
2 Furnace
3 Expansion unit
4 Bending unit
5 Stacking unit
6 Separating device
7 Extruded profile/profile
8 Extrusion billet
9 Die
10 Recipient
11 Angled rail
12 Piercing plug
13 Counter bearing
14 Wedge cutting device
15 Drive and hydraulic unit
16 Clamping unit
17 Hydraulic cylinder
18 Clamping rail
19 Metal sheet
20 Hollow chamber plate
21 Upper side
22 Lower side
23 Inner web
24 Embossing plates
25 3-roller unit
26 Upper roller
27 Lower roller
28 Pair of rollers

The invention claimed is:

1. An apparatus for producing flat metal sheets (19) or hollow chamber plates (20), comprising:

an extruder (1) for producing an extruded profile (7) with a longitudinal opening;

a separating device (6) for cutting the extruded profile (7) to length corresponding to a length of the flat metal sheets (19) or the hollow chamber plates (20) to be produced;

a bending unit (4) for widening the longitudinal opening and creating a-U-shaped configurations of the extruded profile (7);

a first expansion unit (3) for expanding a first of the U-shaped configurations into the flat metal sheets (19) or the hollow chamber plates (20);

a first stacking unit (5) arranged downstream of the first expansion unit (3);

a second expansion unit (3) for expanding a second of the U-shaped configurations of the extruded profile (7) into the flat metal sheets (19) or the hollow chamber plates (20);

a second stacking unit (5) arranged downstream of the second expansion unit (3); and a robot for transferring the first of the U-shaped configurations from the bending unit (4) to the first expansion unit (3) and for transferring the second of the U-shaped configurations from the bending unit (4) to the second expansion unit (3), wherein the extruded profile (7) emerges from the extruder (1) in a direction of extrusion, wherein the first expansion unit (3) and the second expansion unit (3) are arranged parallel to the direction of extrusion on opposite sides of the bending unit (4) such that an axis perpendicular to the direction of extrusion extends through at least a portion of the bending unit (4), the first expansion unit (3) and the second expansion unit (3).

2. The apparatus according to claim 1, wherein the extruded profile is made of magnesium or a magnesium alloy.

3. The apparatus according to claim 1, further comprising a sizing and squeezing device arranged between the first expansion unit (3) and the first stacking unit (5).

4. The apparatus according to claim 3, wherein the sizing and squeezing device is a hydraulic press and comprises two heated embossing plates (24) that can be moved relative to one another.

5. The apparatus according to claim 1, wherein the first expansion unit (3) comprises two clamping devices (16) that can be moved apart and rotated, wherein each of the clamping devices (16) comprises a U-shaped rail and a clamping rail (18) arranged therein, the clamping rail (18) being acted upon by at least two hydraulic cylinders (17).

6. The apparatus according to claim 1, wherein the first expansion unit (3) is formed by a 3-roller unit (25), wherein the 3-roller unit (25) consists of two upper rollers (26) arranged parallel to each other and a lower roller (27) that can be moved towards the upper rollers (26), and wherein a feed or transport unit is allocated to the 3-roller unit.

7. The apparatus according to claim 1, wherein all parts of the apparatus that come into contact with the hollow chamber plates, the extruded profile (7) or the metal sheets (19) are provided with a coating or consist of a magnesium-compatible material in order to prevent direct contact with a ferrous material.

8. The apparatus according to claim 1, wherein the separating device (5) is a non-machining separating device when producing metal sheets (19).

9. The apparatus according to claim 8, wherein the separating device (5) is a wedge or pinch cutting device.

10. The apparatus according to claim 1, wherein the separating device (5) is a machining separating device when producing flat hollow chamber profiles (20).

11. The apparatus according to claim 10, wherein the separating device (5) is a saw.

12. The apparatus according to claim 1, wherein the robot comprises a mechanical or pneumatic gripping system.

* * * * *